United States Patent [19]

Rinelli et al.

[11] Patent Number: 4,461,701

[45] Date of Patent: Jul. 24, 1984

[54] PROCESS FOR RUTILE FLOTATION BY MEANS OF N-BENZOYL-N-PHENYLHYDROXYLAMINE AS A SELECTIVE COLLECTOR

[75] Inventors: Giorgio Rinelli, Rome; Anna M. Marabini, Frascati, both of Italy

[73] Assignee: Consiglio Nazionale delle Richerche, Rome, Italy

[21] Appl. No.: 466,281

[22] Filed: Feb. 14, 1983

[30] Foreign Application Priority Data

Feb. 12, 1982 [IT] Italy ..... 47783 A/82

[51] Int. Cl.[3] ..... B03D 1/14

[52] U.S. Cl. ..... 209/166; 209/167; 75/1 T; 75/2; 252/61

[58] Field of Search ..... 209/166, 167; 75/1 T, 75/2; 252/61; 423/492, 70

[56] References Cited

U.S. PATENT DOCUMENTS 4,362,615 12/1982 Llewellyn et al. ..... 209/166

FOREIGN PATENT DOCUMENTS 871831 10/1981 U.S.S.R. ..... 209/166

*Primary Examiner*—Bernard Nozick

*Attorney, Agent, or Firm*—Pollock, VandeSande & Priddy

[57] ABSTRACT

A process for rutile flotation from rutile ores associated with iron containing components, in which process an alcoholic solution is employed of N-benzoyl-N-phenylhydroxylamine as a flotation collector of rutile. This process is especially suitable for rutile separation by flotation from rutile-hematite ores, with the use of said selective collector at pH values between 1 and 2.5.

3 Claims, 7 Drawing Figures

TRANSMITTANCE %
80
60
40
20
0
(a)
(b)
4000
3000
2500
2000
1800
1600
1400
1200
1000
800
600
400
200
FREQUENCY, cm-1

TRANSMITTANCE %
80
60
40
20
0
(a)
(b)
4000
3000
2500
2000
1800
1600
1400
1200
1000
800
600
400
200
FREQUENCY, cm-1

PROCESS FOR RUTILE FLOTATION BY MEANS OF N-BENZOYL-N-PHENYLHYDROXYLAMINE AS A SELECTIVE COLLECTOR

BACKGROUND OF THE INVENTION

This invention referes to a process for rutile flotation with the use of N-benzoyl-N-phenylhydroxylamine (N-BPHA) as a flotation collector. More particularly, this invention is concerned with a process for the separation of rutile from rutile ores containing iron-bearing components, especially hematite by flotation with N-benzoyl-N-phenyldroxylamine as a flotation collector which forms chelation complex compounds that are stable with titanium but unstable with iron in a well determined concentration and pH range, so that the selective separation of rutile is possible.

The use of chelating agents as flotation collectors has been an experimentation subject for some time, even though with respect to the study of such phenomena per se more than to an analysis of the operating mechanisms. More recently (Peterson et al. 1965, M. C. Fuersstenau et al., 1967, 1970, Marabini and Rinelli, 1975, Nagarau and Somasundaran 1981, etc.) the attention concentrated on the research of flotation collectors of said kind, showing specific selectivity, also as a result of the stimulus of economics motivations.

Difficulties arose in such operation which have not been satisfactorily solved to date, and substantially consisting in the following problems:

(a) the definition of the molecular structure of the chelating agents which should be both water soluble and of sufficient affinity for the air phase in the nonpolar fraction;

(b) the formation of insoluble surface chelates, which is necessary to obtain a suitable selectivity, but with the risk that the excessive chelate stability with respect to the ore crystalline structure may give surface corrosion phenomena, with the possibility of the chelate detachment;

(c) excessive reagent consumption with respect to traditional collectors.

Considering the present situation as depicted above, both as regards the experimentation level and the industrial production and application level, the use is suggested according to this invention of N-benzyl-N-phenylhydroxylamine as a selective collector for rutile ores containing iron-bearing components, especially hematite, which collector allows the reduction or the elimination at a reasonably satisfactory degree of the above mentioned problems.

The fundamental observations which led to the determination of the basic technical teaching suggested in this invention are a result of the study of the rutile/N-benzoyl-N-phenylhydroxylamine system.

As it is well known, N-benzoyl-N-phenylhydroxylamine (N-BPHA) is a hydroxylamine derivative by substitution of two nitrogen atoms with the 1-phenyl and 1-benzoyl groups, according to the following structural formula (I):

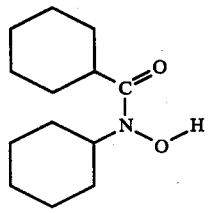

(I)

N-BPHA can also be considered as an N-phenylbenzoylhydroxamic acid (Perrin, 1979), and the water solubility and the chelating action of hydroxyamic acids are well known. On the contrary, N-BPHA is insoluble in water because of the presence of an aromatic ring which substitutes the hydrogen atom of the oxamic group; however, it is soluble in ethyl alcohol and acetone.

The use is well known of such compound (Kaimal and Shome, 1962) in analytical chemistry for the gravimetric determination of titanium. The chelate compound formed in solution between N-BPHA and titanium, according to the elemental analysis, can be written as follows:

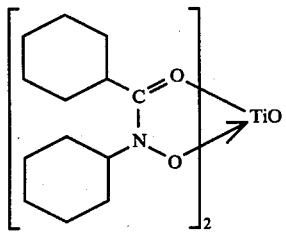

(II)

From the analytical experimentation on the use of N-BPHA for titanium determination in the presence of other different cations including $Fe^{+++}$(Kaimal and Shome) the theoretical indication was drawn, according to the preliminary studies for the formulation for this invention, of a higher stability of the N-BPHA complex compound with titanium with respect to that formed with iron, and consequently the indication of a possible activity of N-BPHA as a flotation collector for rutile, with some selectivity for that ore with respect to iron ores such as hematite which are often associated to it in natural products.

DISCLOSURE OF THE INVENTION

Thus it was surprisingly found according to this invention that under some given operating conditions such selectivity is of a completely satisfactory degree, so that the use mentioned above can be suggested of N-BPHA as a selective flotation collector.

To that aim, the thermodynamic calculation of the apparent constants K', of the different complex compounds formed in solution, under different pH conditions, between N-BPHA and the metals titanium and iron, allowed the evalutation of the $\log_{10} K'$ behavior of each complex compound as a function of pH (FIG. 1). Thus, it was found that the $\log_{10} K'$ values for titanium are between 4 and 5 and they are within the pH range from 1 to 3. In the same range, the values of the apparent constants K' for iron are remarkably lower, and in any case they are always lower than 1. As a result, the stability of the complex compounds with titanium is sufficient to assure the formation of chelate compounds on rutile surface, whereas the iron complex compounds are much less stable, so that there are poor or no possibilites of forming chelate compounds on hematite surface.

Thus the actual possiblity was shown of using N-BPHA as a selective collector for rutile separation from hematite.

Moreover, flotation possibility tests carried out in the Hallimond tube with pure rutile (a sandy type ore with $TiO_2$ content of 97%) and with hematite (an ore from the isle of Elba), both ores being ground to $-65+100$ mesh, gave the results plotted in FIGS. 2 and 3. The following were used as reagents:

N-benzoyl-N-phenylydroxylamine (from Carlo Erba) in alcoholic solution (ethyl alcohol) at the concentration of 2% w/v, HCl and NaOH for pH adjustment.

pH was determined with a digital pH-meter PLINK X-P.

The chelating agent in solution is added to a suspension containing 0.5 g of the ore; then the adjustment is performed of the pH value. The final volume is of about 30 ml. The resulting paste is conditioned for 15 minutes, and then the value of pH is checked. This paste is then passed into the Hallimond tube and its volume is increased up to 80 ml with deionized water. The flotation time is of 6 minutes.

Two fractions are collected (the floated and the unfloated matter) which are dried and weighed; the floated matter percentage (recovery) is calculated from weighed amounts combined. As a result, from FIG. 2 it can be observed that rutile recovery amounts to 100% at pH values between 1.3 and 3.5, whereas maximum recovery of hematite only amounts to 25% in a different range (3–4) of pH values. Such results are therefore in very good agreement with thermodynamical data reported in FIG. 1.

Indeed, it can be remarked that maximum rutile recovery occurs in the pH range wherein the Ti-N-BPHA complex compounds gain a sufficient stability. Such complex compounds, which are presumably formed on rutile surface, induce its flotation.

Maximum hematite recovery is also obtained at pH values which correspond to the maximum stability of the Fe-N-BPHA complex compounds, whereas the poor flotability of the material is to be ascribed to the low values of the apparent constants (FIG. 1). As a consequence, a lower stability occurs of the surface complex compounds formed on hematite with respect to those formed on rutile. Thus the selectivity is assured in rutile flotation at pH values within the range from 1–2.5.

Moreover, with refernce to the flotability curves plotted in FIG. 3, it can be observed that maximum recovery is reached for both minerals at the N-B-BPHA concentration of $1.2\times10^{-2}$ moles/l.

Now it is to be remarked that an increase in the N-BPHA concentration over that value has no influence on rutile flotation (100%), whereas it gives a rapid decrease of hematite flotation down to zero. The phenomenon can be explained by the fact that an alcoholic solution is employed of N-BPHA, so that when the collector concentration is increased, the total amount is also increased of the alcohol (ethyl alcohol) in the solution. Moreover, it has been proved by suitable experimentation that the Ti-N-BPHA chelate is insoluble in the experimental solution at the maximum alcohol concentration (50%), so that the stability of the chelate formed on the rutile surface is unaffected by the presence of the alcohol till maximum collector concentration employed in the experimental tests.

The hematite-N-BPHA surface chelate is much less stable, so that it can redissolve in the presence of excess alcohol with a decrease in the relative flotability.

In conclusion it has been observed according to this invention that maximum selectivity in the rutile-hematite minerals flotation is reached at the major collector concentration of $2\times10^{-2}$ moles/l, at which the hematite recovery drops to zero.

It is accordingly a specific object of this invention a process for rutile flotation from rutile ores associated to iron-bearing components, which process is characterized in that an alcoholic solution of N-benzoyl-N-phenylydroxylamine is used as a selective flotation collector of rutile.

Moreover, according to this invention the application is also particularly interesting of the process out lined above to rutile-hematite ores with the employment of an ethyl alcohol solution of N-BPHA as a selective collector in the pH range between 1 and 2.5.

On the basis of the above observations, this invention suggests, in the case of the rutile-hematite minerals, to operate at a N-BPHA concentration higher than $2\times10^{-2}$ moles/l in order to obtain the highest rutile recovery.

The following drawings, already mentioned above have been included for illustrative but no means limitative aims, to allow a clearer understanding of the invention:

As regards the chelate characterization, we had recourse to the study of IR spectra of the Ti-N-BPHA chelate in solution as well as on the rutile surface.

The Ti-N-BPHA chelate to be tested was precipitated by the reaction of a titanium sulfate solution with a N-BPHA solution in ethyl alcohol. The precipitate so obtained was rinsed and dried under vacuum. The compound obtained is a crystalline solid of a deep yellow color, which is water insoluble, but is soluble in ethyl alcohol.

Figure 1:
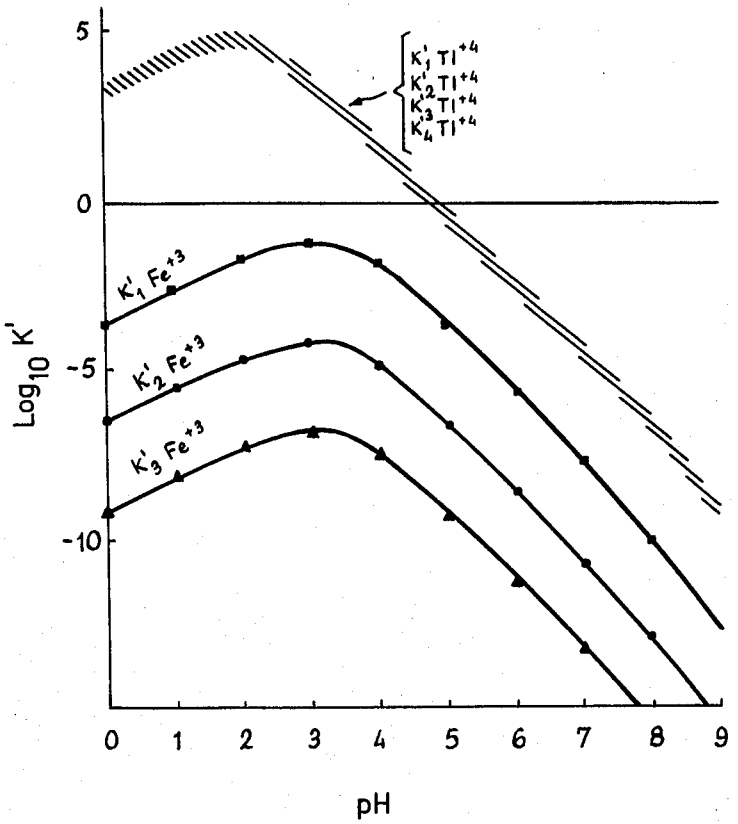
FIG. 1 is a plot showing the behavior of the apparent constants K' for titanium and iron, which are expressed as the $\log_{10} K'$ (as the ordinates) as a function of pH (as the abscissa)
Figure 2:
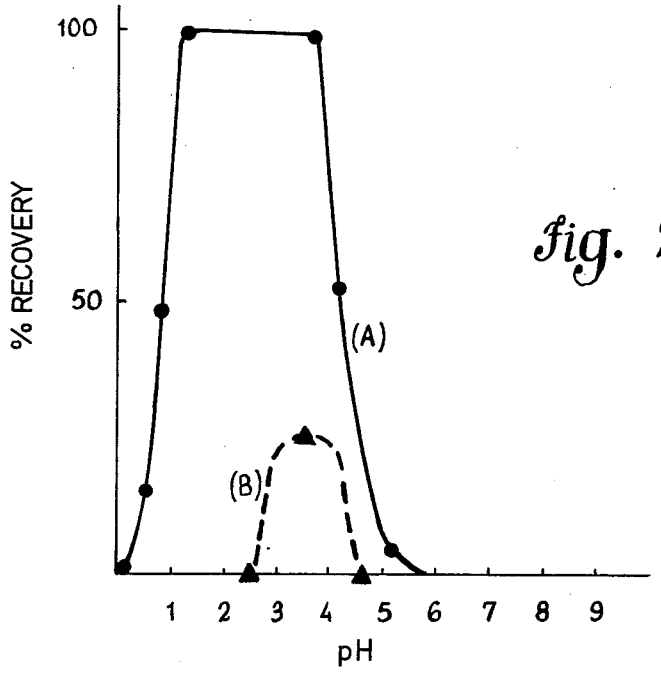
FIG. 2 is a plot illustrating the flotation behavior expressed as percent recovery (as the ordinate) for rutile (A) and for hematite (B) as a function of the pH values as the abscissas (N-BPHA$=1.4\times10^{-2}$ M)
Figure 3:
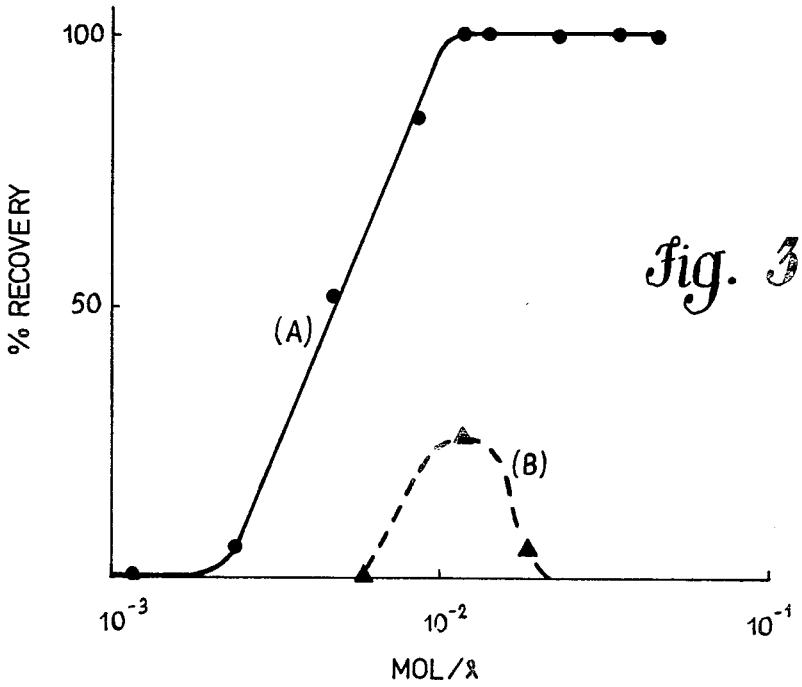
FIG. 3 is a plot illustrating the behavior of the percent recovery (as the ordinate) of rutile (A) and hematite (B) as a function of N-BPHA concentration (pH=3.5) as the abscissa.
Figure 4:
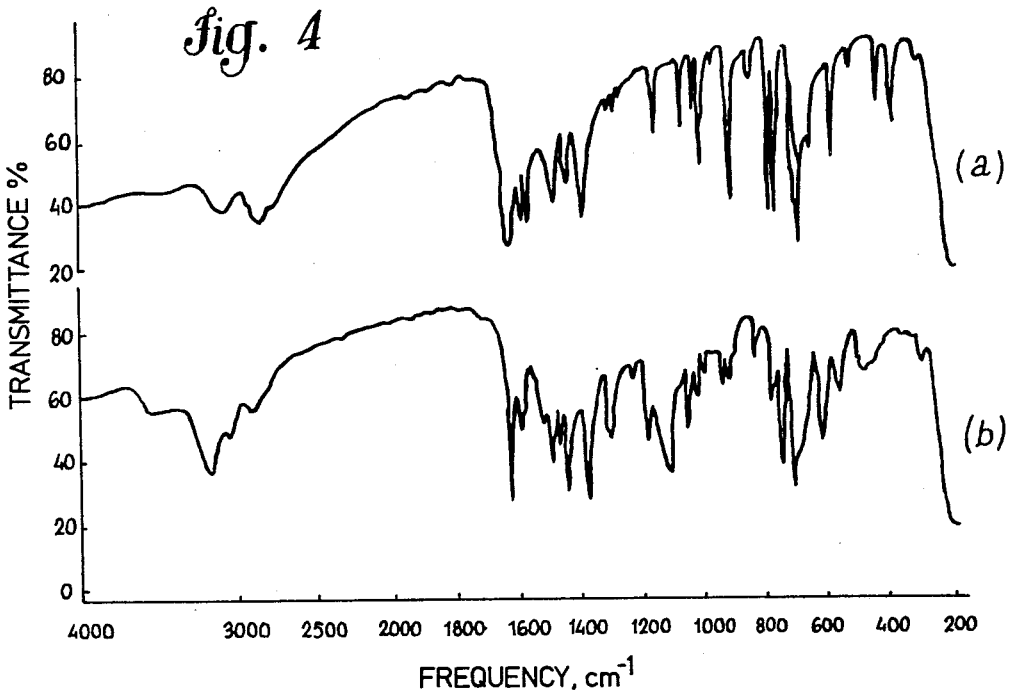
FIG. 4 is a plot of percent transmittance (as the ordinate) as a function of IR frequencies of N-BPHA (a) and of the titanium-N-BPHA chelate (b) as the abscissas.

A comparison between the IR spectrometric results for the chelate (curve a) and those for N-BPHA (curve b), which are showen in FIG. 4, gives the characteristic modifications of the chelate. The main changes in the spectrum are:

(1) the shift of many peaks of the —OH, C—N—C and C═O frequencies towards higher frequencies, as a result of titanium substitution for the hydrogen in the hydroxyl groups and of the formation of the chelating link between titanium and N-BPHA;

(2) the strong decrease in the peaks at 850 770 $cm^{-1}$;

(3) the decrease as well as the shift towards higher frequencies of peaks below 700 $cm^{-1}$ relatively to the crystalline structure of the chelate;

(4) the appearance of new absortion bands (1520, 1530, 1470, 1235, 900, 835 and 750 $cm^{-1}$) which are likely to be due to the new N—O—Ti bonds (560 $cm^{-1}$) with reference to the C═O—Ti coordination bonds (1120, 450 and 500 $cm^{-1}$) as a result of the new Ti—O bonds in the crystalline strupture; and (5) the disappearance of the peaks at 390, 420 and 440 $cm^{-1}$, which results from a chelate decrease with respect to N-BPHA.

The surface chelate formation is put into evidence by adsorption experiments on rutile. A given amount of the ore (0.5 g) is conditioned at pH 3-4 with 20 ml of a solution containing 1 g of aN-BPHA in 1/1 water/ethyl alcohol.

After conditioning, the solids are separated from the liquid by centrifugation, then they are dried under vacuum at 60°-70° C. and analyzed by IR spectrometry.

Figure 5:
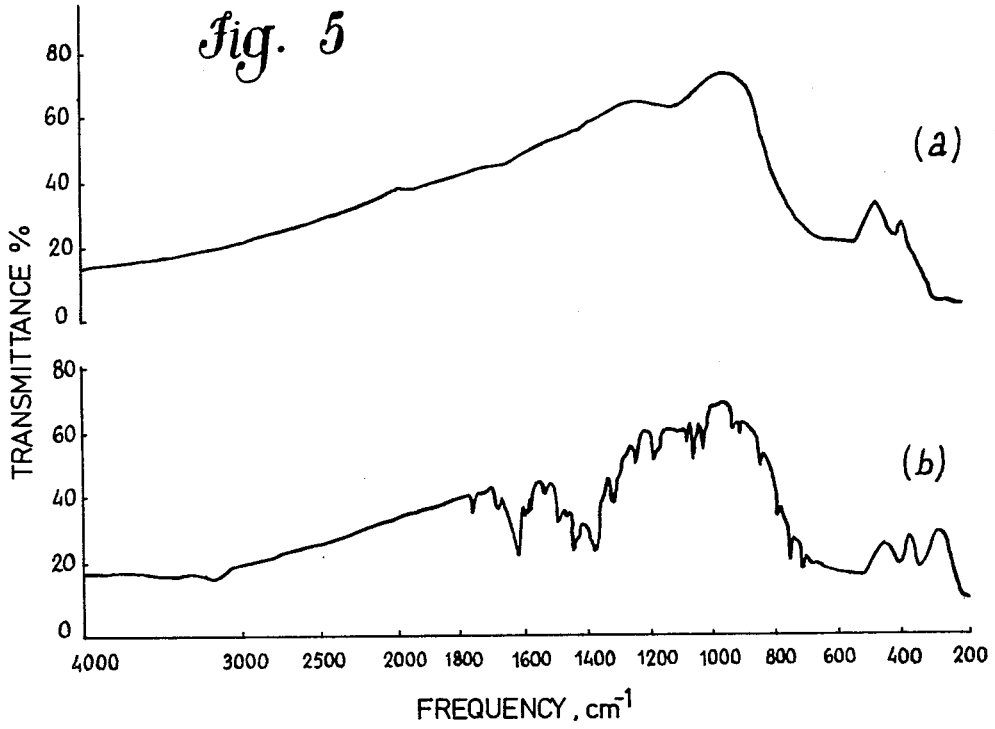
FIG. 5 is a plot analogous to that of FIG. 4 with reference to the IR frequencies of rutile, treated with N-BPHA (a) and untreated (b)

Curves (a) and (b) of FIG. 5 are the spectra of the treated and the untreated rutile respectively. A comparison of such spectra shows very clearly the formation of the characteristic frequencies of the Ti-N-BPHA chelate. The only difference consists in the appearance of four new peaks at 1760, 1680, 1270, and 1040 $cm^{-1}$ for the surface chelate, as well as the disappearance of the broad band at 1120 $cm^{-1}$. Such peaks presumably concern groups which are characteristic of the inorganic matrix. They are the Ti—O and TiO—$SO_4$ groups. Indeed, titanium sulfate shows a broad characteristic band at about 1000 $cm^{-1}$.

Figure 6:
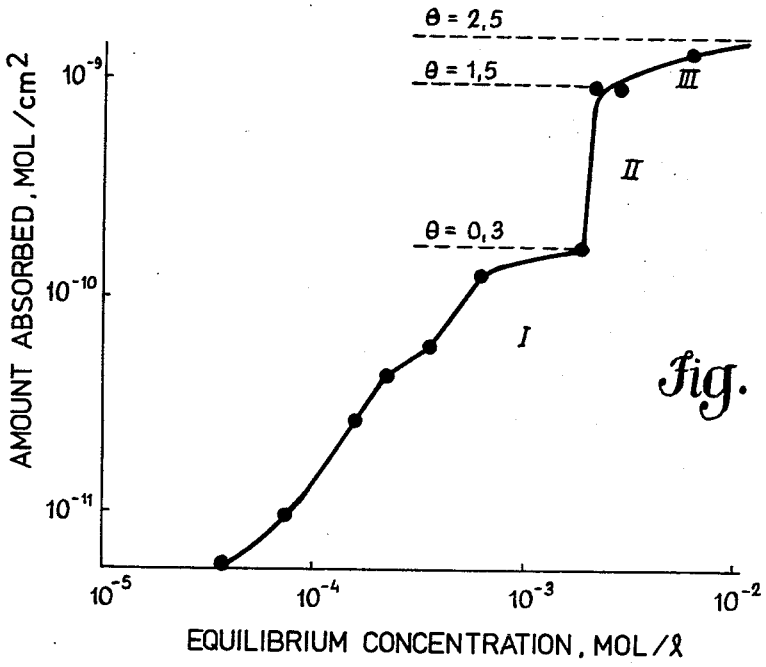
FIG. 6 is a plot of the behavior of the N-BPHA adsorbed amount in moles/cm$^2$, at a constant temperature, on the rutile surface (as the ordinate) as a function of the equilibrium concentration in moles/l as the abscissa.
Figure 7:
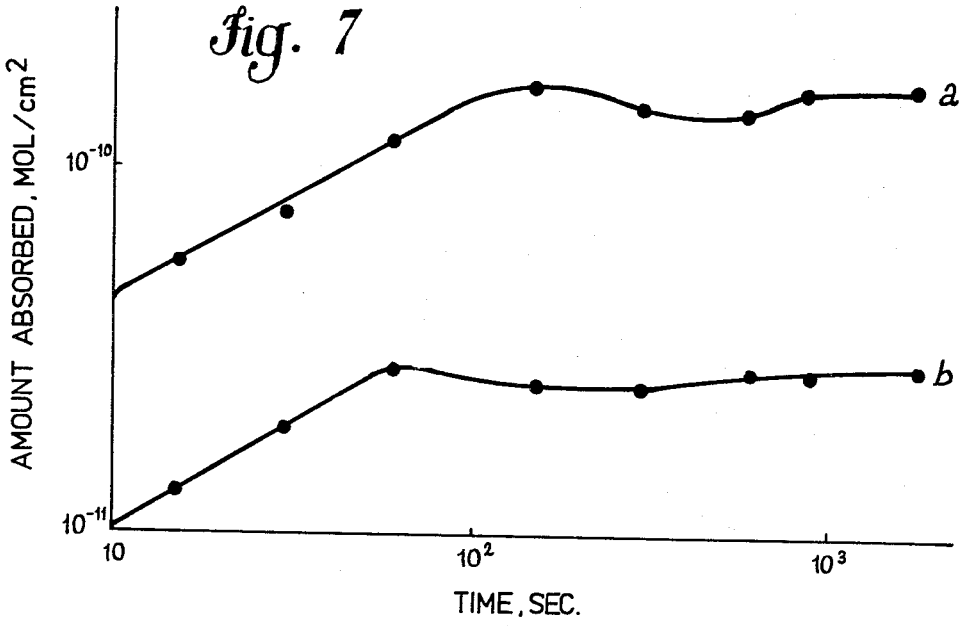
FIG. 7 is a plot illustrating the N-BPHA absorbed amount in moles/cm$^2$ as the ordinate as a function of time in seconds (as the abscissa).

As far as the N-BPHA adsorption on rutile is concerned, results are plotted in FIGS. 6 and 7 as already mentioned above. In FIG. 6, the adsorption isotherm divides into three different regions, pointed out as I, II and III. The adsorption mechanism can be hypothesized, yet theorically, as based on two main assumptions, according to which:

(1) the isotherm equilibrium concentrations are equivalent to the initial concentrations which are represented in the flotation curves; indeed, the amount of ligand extracted from the solution in the flotation tests is negligible, because the average specific surface of the ore employed (0.5 g) is of 80 $cm^2/g$ as compared to the value of 12,500 $cm^2/g$ of the ore employed in the adsorption experiments (4 g);

(2) the cross-section area of the ligand molecule can be assumed to be of 26 $A^{\circ 2}$, an equal value being attributable of probability to any possible orientation of the N-BPHA molecule surface, which is substantially flat and has an area of 52 $A^{\circ 2}$.

From such assumptions, the region (I) of the isotherm can be inferred to correspond to the non-flotation zone, whoose utmost concentration limit is $2\times10^{-3}$M. Surface coating at such equilibrium concentration is 0.3. In such zone the chelation reaction controls the isotherm behavior. The characteristic "s" shape can be ascribed to the occurrence of a partial condensation of the ligand molecule, which is favoured by the hydrophilic nature of the N-BPHA functional group.

It is to be remarked that the concentration of $2\times10^{-3}$M can be considered of critical value, as the almost infinite slope of the (II) portion of the isotherm shows condensation phenomena at concentrations close to such value. This important zone shows a clear-cut analogy with the bidimensional condensation observed in chemisorption of alkyl collectors (Predali and Cases, 1974). In that zone, the value of increases from 0.3 to 1.5. In this connection, it is important to observe that rutile flotation starts at the critical concentration, but it keeps within very low recovery values, this phenomenon being presumable on the basis of the low hydrophobic character of a specific coating made up of molecules of an aromatic structure, different from the structure of the alkyl chain layers.

Flotation increases linearly above the critical concentration, the isotherm (zone III) ahowing a behavior close to saturation. Complete flotation (100%) occurs at a concentration of $2\times10^{-2}$M with O=2.5. The complete flotation with a coating in excess to the monolayer can be considered (Marabini, 1978) as a peculiar characteristic of the action of aromatic ligands, though at the present time the determination of the structure of the adsorbed layers is quite a problem.

Lastly, it is interesting to observe the results of the adsorption kinetics plotted in FIG. 7 concerning the N-BPHA adsorption on rutile at two different concentrations, i.e. at $2.3\times10^{-3}$M (curve a) and $2.3\times10^{-4}$M (curve b). Adsorption at both concentrations was limited to a specific coating lower than 0.3.

FIG. 7 shows that the amount of the reactant adsorbed per unit surface increases linearly with time up to a fixed value within 1-2 minutes. As a consequence, the adsorption can be expressed as a function of time in the form of an equation of the kind $$\Gamma = at^{1/n}$$

(Bogdanov, 1960), which is indicative of a high rate process, in agreement with the characteristic chemical nature of the interaction between N-BPHA and rutile surface.

In conclusion, the fact can be stressed that the employment of N-BPHA as a selective flotation collector for rutile separation from hematite shows of remarkable interest for the realization of a new industrial procedure for concentrating titanium minerals from their ores by separation from the iron-bearing components.

This invention has been disclosed with particular reference to some specific embodiments, but it is to be understood that changes and modifications can be introduced in its embodiment without departing from its spirit and the scope of its claims.

What is claimed is:

1. A process for rutile flotation from rutile ores associated with iron bearing components, characterized in that an alcoholic solution of N-benzoyl-N-phenylhydroxylamine is employed as a selective flotation collector of rutile.

2. A process for rutile flotation according to claim 1 for rutile separation from rutile-hematite ores, characterized in that said selective flotation collector of rutile is made up of a N-benzoyl-M-phenylhydroxylamine solution in ethyl alcohol, the flotation process being carried out at a pH between 1 and 2.5.

3. A process for rutile flotation from rutile-hematite ores according to claim 2, characterized in that the N-benzoyl-N-phenylhydroxylamine concentration is higher than $2\times10^{-2}$ moles/l.

* * * * *